US005526616A

United States Patent [19]

Bamberg

[11] Patent Number: 5,526,616

[45] Date of Patent: Jun. 18, 1996

[54] BURIAL VAULT

[76] Inventor: David J. Bamberg, 1511 Kenlyn Dr., Longwood, Fla. 32779

[21] Appl. No.: 506,422

[22] Filed: Jul. 24, 1995

[51] Int. Cl.[6] ..... E04H 13/00

[52] U.S. Cl. ..... 52/138; 52/142

[58] Field of Search ..... 52/131, 138–142, 52/DIG. 14, 134

[56] References Cited

U.S. PATENT DOCUMENTS

| | | | |
|---|---|---|---|
| 709,988 | 9/1902 | Kerr, Jr. | 52/142 |
| 786,094 | 3/1905 | Boyden | 52/142 X |
| 883,492 | 3/1908 | Searle | 52/142 |
| 1,190,579 | 7/1916 | Pegg | 52/139 |
| 1,470,130 | 10/1923 | Slyke | 52/138 |
| 1,792,380 | 2/1931 | Doux | 52/142 |
| 2,192,291 | 3/1940 | Patterson | 52/138 X |
| 2,247,617 | 7/1941 | Metz | 52/141 X |
| 2,940,156 | 6/1960 | Cook | 27/35 |
| 3,172,183 | 3/1965 | Bugg | 27/7 |
| 3,208,186 | 9/1965 | Fulton et al. | 52/140 |
| 3,208,188 | 9/1965 | Fulton et al. | 52/138 |
| 3,868,799 | 3/1975 | Hayward | 52/131 |
| 4,249,289 | 2/1981 | Work | 27/35 |
| 4,288,952 | 9/1981 | Work | 52/138 |
| 4,315,353 | 2/1982 | Sorensen | 27/2 |
| 4,967,523 | 11/1990 | Turpin | 52/124.2 |

FOREIGN PATENT DOCUMENTS

| | | | |
|---|---|---|---|
| 722356 | 11/1965 | Canada | 27/2 |
| 984774 | 7/1951 | France | 52/141 |

*Primary Examiner*—Lanna Mai

*Attorney, Agent, or Firm*—Edward M. Livingston

[57] ABSTRACT

A burial vault (1) designed to hold a standard casket (10), having a dome-like cover unit (2) and a generally rectangular base unit (3), each unit being of the same size so as to mate together around the edges (19,20) at a joint section. The cover unit has a plurality of interconnecting reinforcing ribs (15) running lengthwise along side walls (13) and end walls (11), across a top wall (14) and vertically down the side and end walls of the cover unit. The vertical ribs (16, 12) on the end of the side walls are sufficiently open and wide enough on a bottom end to fit over and interlock with ribs (6) on side walls (21) of the base unit. The joint section around the edges of the units consists of concave flange (9) in the cover unit which is received by a concave flange (5) in the base unit when the units are mated to form a burial vault. A sealing material (22), such as an elastomeric material like Butyl rubber, may be placed between the flanges prior to mating so as to provide a seal to prevent intrusion of moisture, leaking of chemicals or the extrusion of chemicals or gases from within the vault into the ground water. Thus, this improved burial vault not only provides a much stronger vault due to its interconnecting and interlocking ribs, but an environmentally-safe vault as well.

5 Claims, 5 Drawing Sheets

BURIAL VAULT

BACKGROUND OF THE INVENTION

The present invention relates to burial vaults and more particularly, to a burial vault that provides a stronger and environmentally safe vault.

Standard caskets must be enclosed within a vault for burial purposes for several reasons. One reason is a casket that cannot withstand the weight of fill dirt or other materials or items on the casket. As caskets can be very expensive, a further reason for enclosing them in a burial vault is to help prevent damage to the caskets which could result from fill dirt, stones or other materials placed over the casket during burial. Unfortunately, most traditional burial vaults are not sufficiently strong and are not portable, but instead are built into the ground around the casket and are made of concrete. Furthermore, such traditional vaults do not prevent the intrusion of moisture into the vault and casket, or the leaking of chemicals used in the embalming process or fluids or gases from decomposition into the ground water.

Thus, a need exists for a burial vault that is portable, strong enough to protect the casket which provides a seal that prevents damage to the inner contents of the vault and to the exterior environment. The prior patented art includes numerous burial vaults, some with ribs and interlocking seals, but none like the present invention. The most pertinent prior patented art is as follows:

| Patent No. (U.S. unless stated otherwise) | Inventor | Issue Date |
|---|---|---|
| CAN 722,356 | Bugg | Nov. 30, 1965 |
| 3,172,183 | Bugg | March 9, 1965 |
| 2,940,156 | Cook | June 14, 1960 |
| 4,228,952 | Work | Sept. 15, 1981 |
| 4,249,289 | Work | Feb. 10, 1981 |
| 3,868,799 | Hayward | March 4, 1975 |
| 3,208,186 | Fulton, et al. | Sept. 28, 1965 |
| 4,315,353 | Sorensen | Feb. 16, 1982 |
| 4,967,523 | Turpin | Nov. 6, 1990 |

The two patents issued to Bugg teach a plastic vault with edges that are sealed in a rubber material to seal a vault, but it does not teach meshing "U"-shaped flanges. The Cook patent teaches a vault wherein the top fits into a trough in the bottom, but it still does not teach the use of mating "U"-shaped flanges. The patents issued to Work teach plastic vaults with an elastomeric seal between the top and bottom, but none use mating flanges for the seal like the present invention. The Hayward patent teaches another vault with an elastomeric seal to prevent gas and liquid leakage, but it is still different from the present invention. The Fulton patent teaches another plastic vault that also uses elastomeric sealing. The Sorensen patent teaches a sealing vault within a trough to collect fluid inside the vault. The Sorensen patent also teaches the use of reinforcing ribs, but not with the same design as the present invention. Finally, the Turpin patent teaches a vault with a sealable dome and base, but it still does not use "U"-shaped flanges.

None of the above patents provides a strong, environmentally safe burial vault using interconnecting and interlocking ribs and "U"-shaped sealing flanges as does the present invention.

SUMMARY OF THE INVENTION

Major objects of the present invention are as follows:

To provide a vault for enclosing and protecting standard caskets for burial;

To provide a vault that is designed to withstand extreme external pressures caused by fill dirt and other external forces;

To provide a vault that is environmentally safe by means of a special seal to prevent intrusion of moisture into the vault or extrusion of chemicals or gases from within the vault into the surrounding ground; and To provide such a vault that is portable.

The present invention fulfills the above and other objects by providing a burial vault having two units, a dome-like cover unit and a generally rectangular based unit, each designed to mate together at their joining edges. The cover unit has a top wall which is slightly curved and two side walls and two end walls extending therefrom. High strength is provided by inter-connecting reinforcing ribs, one rib running along the side walls and end walls near the top wall of the cover unit which is interconnected to a plurality of crosswise reinforcing ribs running across the top and vertically down each side into two vertical reinforcing ribs, one on each end wall of the cover unit. The cover unit is open on the bottom so that it can be placed over a selected casket. The bottom unit has two shallow side walls and two shallow end walls extending upward from a floor to support a casket placed thereon. The base unit has a plurality of crosswise ribs running along the side walls and across its floor in locations matching the ribs on the cover unit and a rib on each end wall. All of said ribs on the bottom unit being slightly narrower than the vertical ribs on the cover unit to allow the bottom unit to slide into openings on the bottom of the cover units' vertical ribs so as to interlock the two units together. An interlocking joint runs around the edges of the cover unit and the base unit so that when the cover unit is placed over the base unit, the cover unit and base unit are locked together against transverse movement. The joint may comprise a convex flange around the edges of the cover unit which mates with and is received by a concave flange running around the bottom edges of the base unit. In order to environmentally seal the cover unit to the bottom unit, a sealing material, preferably an elastomeric substance such as Butyl rubber, is placed between the two flanges prior to mating.

The above objects and other advantages of the present invention will become even more readily apparent when a detailed description of a preferred embodiment is described in conjunction with the drawings appended hereto.

BRIEF DESCRIPTION OF THE DRAWINGS

The drawings that are used in conjunction with a description of a preferred embodiment are as follows.

DETAILED DESCRIPTION OF THE PREFERRED EMBODIMENT

Figure 1:
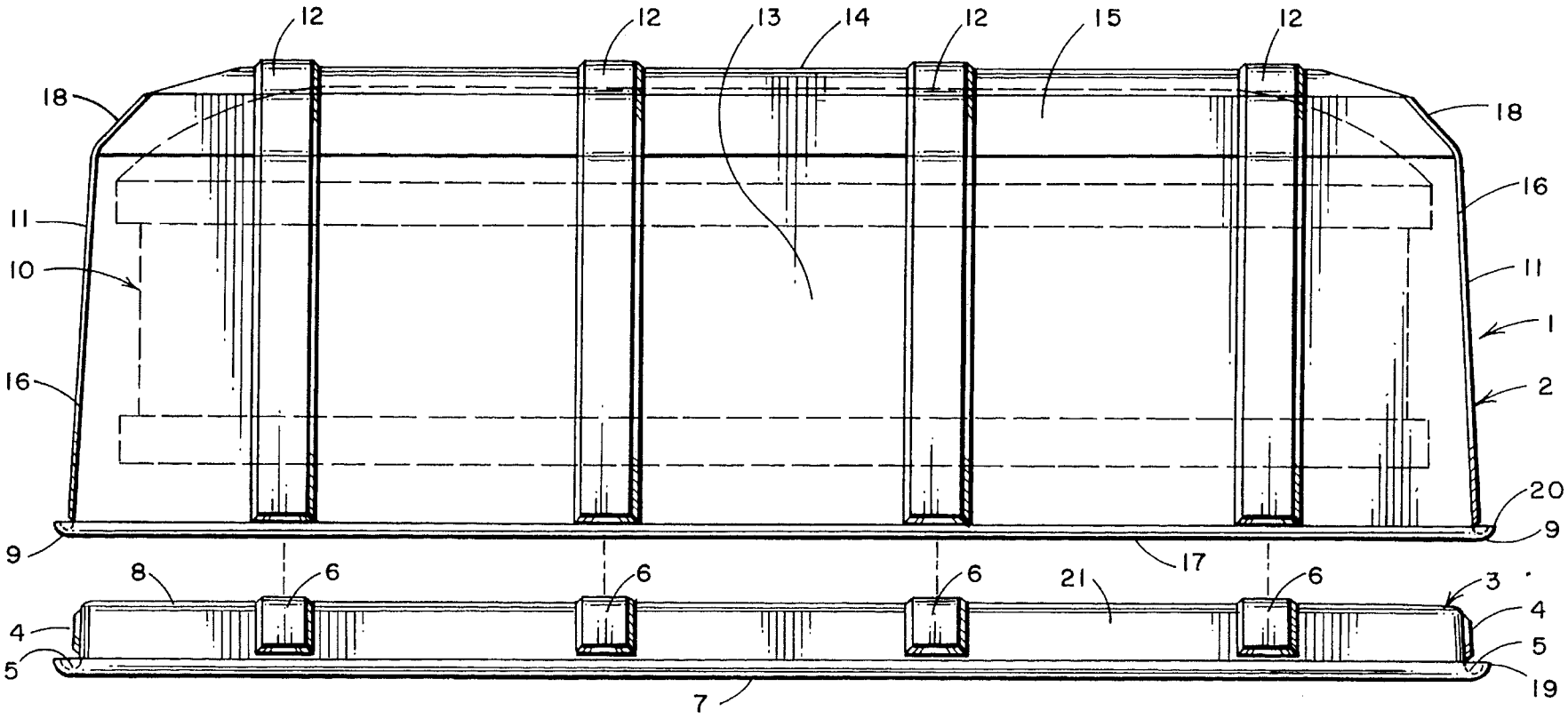
FIG. 1 is a side view of the burial vault with the cover unit and base unit separated and showing a casket in plan view.
Figure 2:
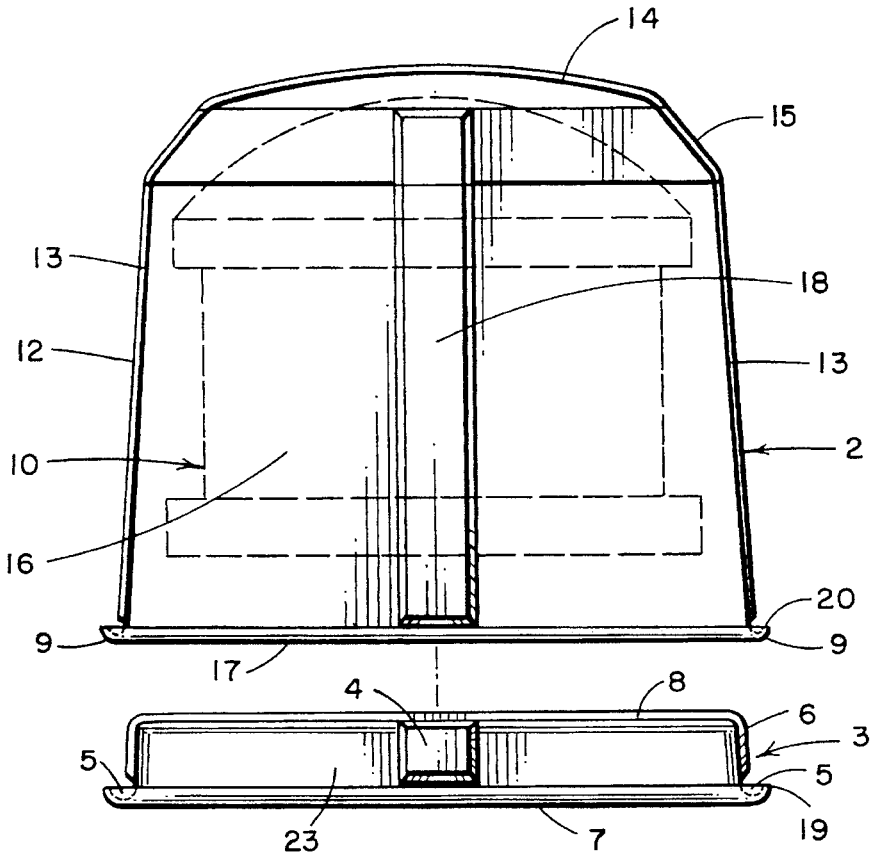
FIG. 2 is a end view of the burial vault of FIG. 1.

Referring to FIGS. 1 and 2, the burial vault 1 is shown being comprised of two units, a cover unit 2 and base unit 3. As illustrated, the base unit has a floor 8 supporting a casket 10. The floor 8 is reinforced by a plurality of crosswise ribs 6. The base unit 3 is generally rectangular in shape and has shallow side walls 21 and end walls 23 between the floor 8 and bottom surface 7 of the base unit. The end wall 4 of the base unit 3 also contains a rib 4 which is designed to interlock with the vertical rib 11 on the end wall 16 of the cover unit. Other notable features on the base unit 3 are the concave flange 5 that runs around the periphery of the base unit 3, leaving an upturned outer edge 19.

The cover unit shown in FIGS. 1 and 2 is slightly dome-shaped due to a slightly curved top wall 14 and side walls 13 and end walls 11 which depend from the top wall 14 at a slight outward angle from the vertical. The cover unit is designed to withstand great pressure from the top by means of its interconnecting reinforcing ribs. For instance, running longitudinally along the side walls 13 near the top wall 14 are two ribs 15 which are interconnected with a rib 18 on each end wall. These ribs are in turn interconnected with a plurality of crosswise ribs 12 over the top wall 14 of the cover unit 2 and vertically down the side walls 13. The latter lengthwise ribs 15, crosswise ribs 12 and (side and) end ribs 15 and 18 are in turn interconnected with a vertical rib 16 on the end wall 11.

Each of the vertical ribs on the cover unit 2, those ribs comprising the side ribs 12 and end wall ribs 11, are positioned so that they align with the side wall ribs 1 and end wall ribs 4 in the base unit 3. The bottoms of these vertical ribs 12 and 11 on the cover unit 2 are slightly wider than the ribs 6 and 4 in the base unit so the cover unit ribs fit over the base unit ribs. Thus, the overall burial vault is reinforced by the interconnecting ribs. The cover unit 2 contains a convex flange 9 with edge 12 which fits into and is received by a concave flange 5 and turned-up edge 19 running around the periphery of the bottom unit 3. Thus, the weight of the cover unit 2 and of any fill dirt or other items placed on top of the cover unit 2 direct the downward pressure to keep the convex flange 9 on the cover unit 2 in contact with the concave flange 5 on the base unit even more firmly in place.

Figure 3:
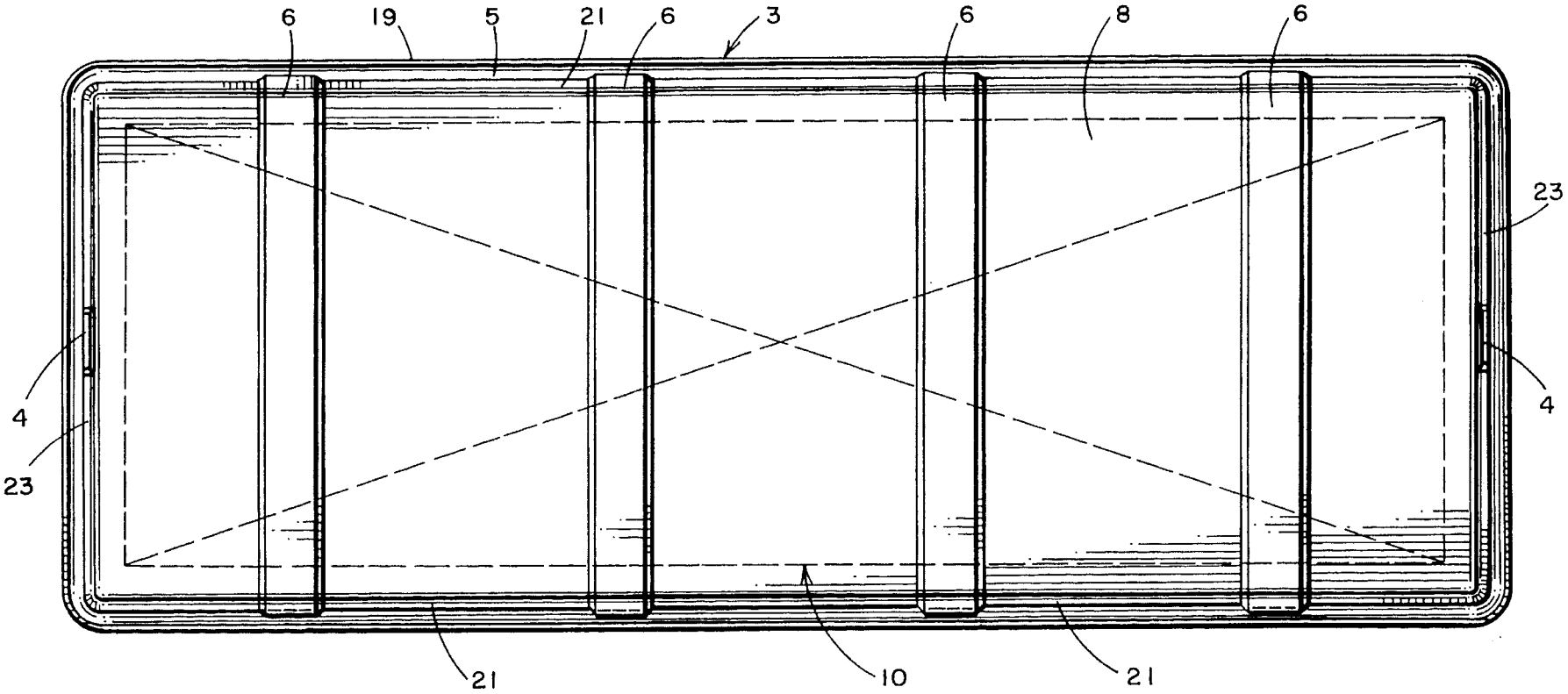
FIG. 3 is a top view of the base unit of the burial vault with casket in plan view.

Referring now to FIG. 3, the base unit 3 is shown with a casket 10 in plan view resting thereon. In this view the supporting floor 8 is shown surrounded by the side walls 21 and end walls 23. A plurality of crosswise ribs 6 extend over the floor 8 and down each side wall 21 of the base unit 3. On the periphery of the base unit 3 is a concave flange 5 with upturned edge 19 designed to join with the convex seal 9 in the cover unit 2. The end walls 23 of the base unit 3 have a vertical rib 4 which is designed to interconnect with the vertical end wall rib 11 of the cover unit 2 when it is placed over the base unit 3.

Figure 4:
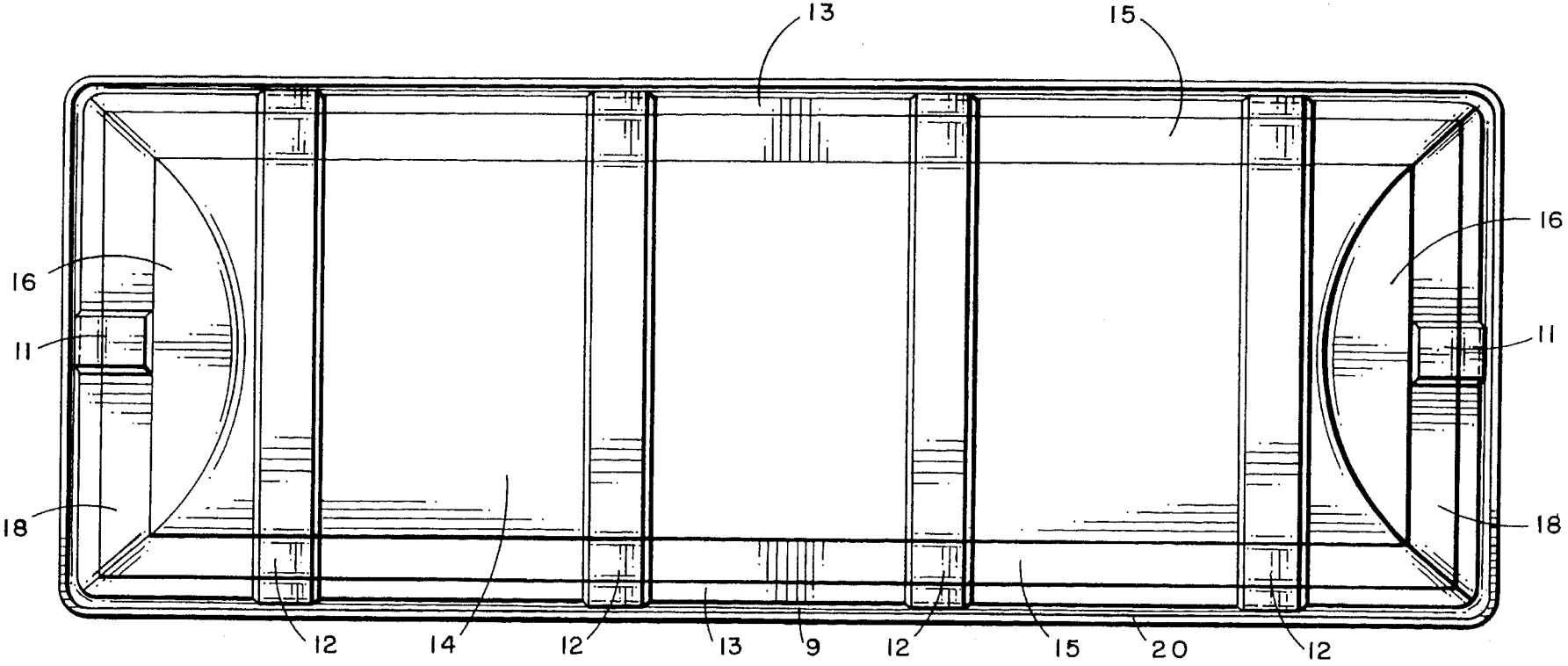
FIG. 4 is a top view of the cover unit of the burial vault.
Figure 7:
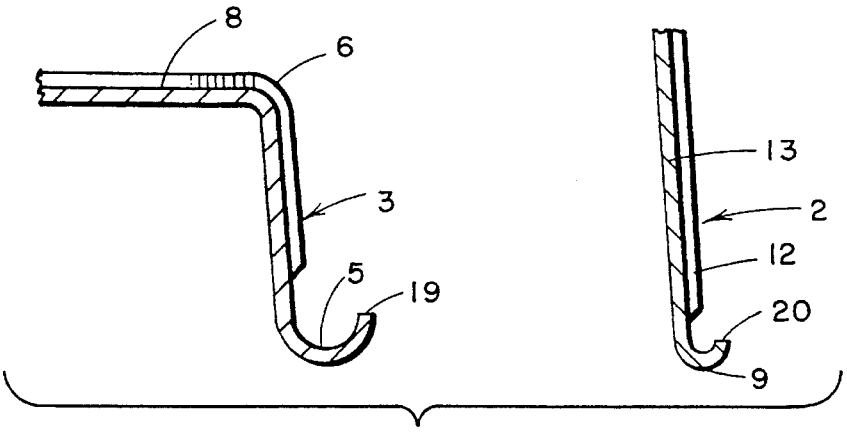
FIG. 7 is a partial cross-sectional side view of a joint section of the cover unit and base unit of the burial vault.
Figure 8:
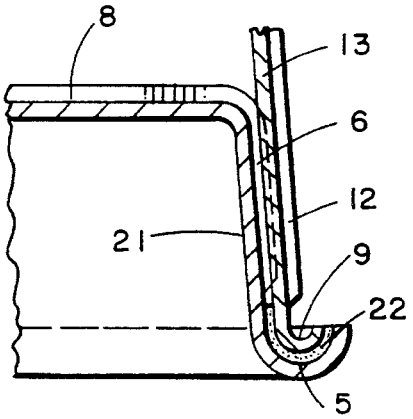
FIG. 8 is a partial cross-sectional plan view showing the joint section when the cover and base units are mated in a sealed position.

Referring to FIG. 4, the cover unit 2 is shown with its slightly curved top wall 14 with side walls 13 and end walls 11 depending downward therefrom at a slight angle to form a dome-like cover unit sufficiently large enough to cover a selected casket. As mentioned previously, the cover unit has a plurality of crosswise ribs 12 which run over the top wall 14 and down the side walls 13. These crosswise ribs 12 interconnect with lengthwise ribs 15 which run latitudinally down the side walls 13 and connect with crosswise ribs 18 on the end walls 11. The interconnection of the ribs provides extreme strength to the burial vault.

Figure 5:
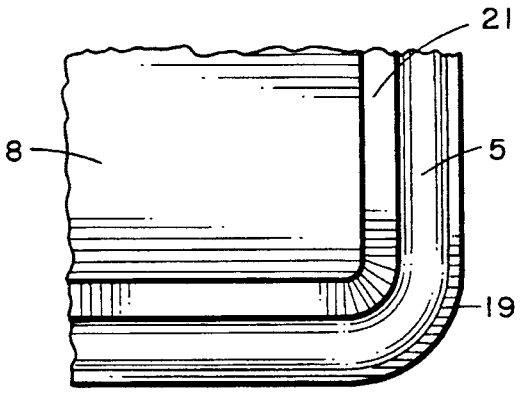
FIG. 5 is a top view of one corner of the bottom unit of the burial vault.

In FIG. 5 a corner of the base unit 3 is illustrated showing the floor 8 surrounded by side walls 21. Around the periphery is a concave flange 5 with upturned edge 19.

Figure 6:
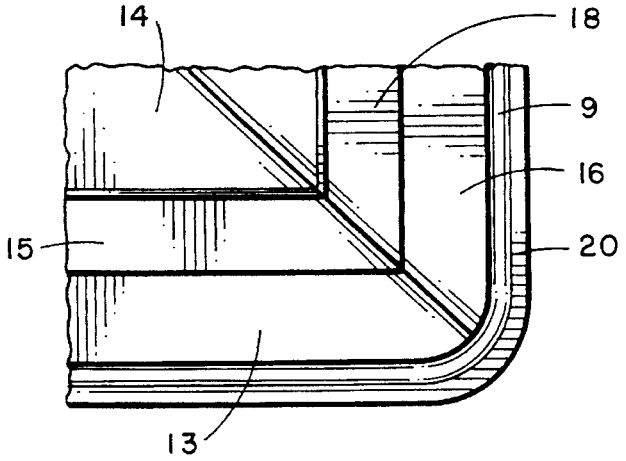
FIG. 6 is a partial cross-sectional top view of a corner of the cover unit of the burial vault.

Similarly, FIG. 6 shows a cutaway portion of the corner of the cover unit 2 illustrating the top wall 14, lengthwise side wall rib 15 and end wall rib 18. The side wall 13 and end wall 11 depend downwardly from the top wall 14 to meet a concave flange 9 with upturned edge 20 around the periphery of the side and end walls.

Referring to FIG, 7, the joint sections of the cover unit 2 and base unit 3 are illustrated in cutaway cross-sectional fashion. The cover unit 2 contains a wall 13 with side rib 12. At the bottom of the side wall 13, around the periphery of the entire cover unit 3 is a convex flange 9 with upturned edge 20. This convex flange 9 is designed to be received by the concave flange 5 in the base unit 3.

FIG, 8 shows the two joint sections when sealed together. In this illustration, the cover unit 2 with its side wall 13 and convex peripheral flange 9 is shown placed in the concave flange 5 around the periphery of the side wall 21 of the base unit 3. The rib 6 on the base unit 3 is shown in plan view as fitting into an indentation on the inside of the wall 13 of the cover unit 2 aligned with the rib 12 so as to lock the cover unit 2 to the base unit 3. The two units are sealed together at the flange area by the insertion of a sealing material 22. The sealing material would preferably be an elastomeric substance such as Butyl rubber, which is placed between the convex portions 9 of the cover unit 2 and the concave receiving portion 5 of the base unit 3. The adjoining flange sections of the units are designed to provide a seal which would improve even as more pressure were added on top of and around the cover unit 2. This seal would prevent intrusion of moisture or other elements into the vault as well as the leaking of chemicals or gases from inside the vault into the ground water, thus, preventing damage to the environment.

Figure 9:
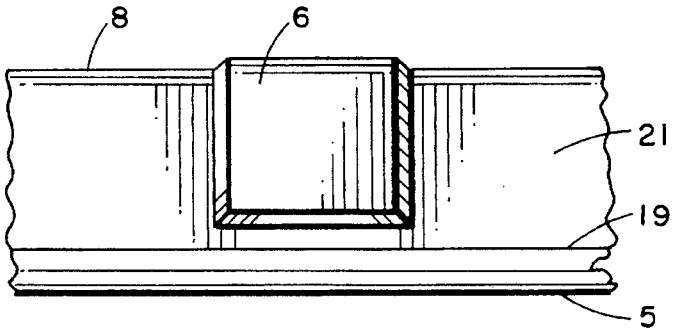
FIG. 9 is a frontal view of a rib on the base unit.
Figure 10:
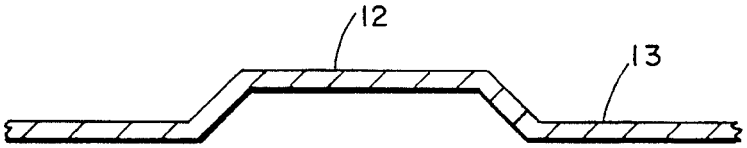
FIG. 10 is a partial cross-sectional top view of a side wall of the cover unit showing the rib portion.

FIGS. 9 and 10 illustrate the interlocking feature of the side wall ribs 12 on the cover unit 2 with the ribs 6 on the side walls 21 of the base unit 3. As shown in FIG. 10, the ribs 12 on the cover unit 2 are merely outward extensions of the side wall 13. The ribs 12 are extended outward sufficiently from side wall 13 to fit over and interlock with the ribs 6 on the base unit 2. This interlocking feature prevents the separation of the two units which may be caused by transverse forces.

The burial vault and its two units may be made of almost any rigid material. Due to its special construction, it could be made of even a light weight materials, including plastic such as polystyrene or aluminum, and still have sufficient strength to withstand exterior pressures.

Although a detailed description of one preferred embodiment has been described in conjunction with the drawings, it is to be understood that the invention may take various forms and have many variations and modifications which are still within the scope of this invention.

Having thus described my invention, I claim:

1. A burial vault comprised of two units, a dome-like cover unit and generally rectangular base unit, further comprising:

the cover unit having a slightly curved top wall connected to two end walls, two side walls and an open bottom to form a dome sufficiently large enough to hold a selected casket to be placed therein, said cover unit having a first reinforcing rib running longitudinally along the side and end walls and of the cover unit, said first reinforcing rib being connected to two vertical reinforcing end ribs, one on each end wall of the cover unit, said first reinforcing rib being further connected to a plurality of reinforcing ribs running latitudinally crosswise in spaced distances along the length of the cover unit, each of said end and crosswise ribs being outward extensions of the side walls of the cover unit and wide enough to slide over ribs in matching locations on the base unit and interlock with the ribs on the base unit;

the base unit having two shallow side walls, two shallow end walls and a floor between said walls to support a casket placed thereon, and further having crosswise reinforcing ribs running from a side wall to an opposite side wall over the floor of the base unit, said ribs being slightly narrower than the ribs on the cover unit so as to slide into and interlock with the ribs on the side wall of the cover unit; and an interlocking sealing joint means around a periphery of the edges of both the cover unit and base unit so that when the cover unit is placed over the base unit the cover unit and base unit are locked together.

2. The burial vault of claim 1 wherein the interlocking sealing joint means comprises a convex flange around the periphery of the cover unit and a concave flange around the periphery of the base unit, said concave flange being of selected size to receive and hold the convex flange when the cover unit is placed onto the base unit.

3. The burial vault of claim 2 wherein the interlocking joint means further comprises a sealing material placed between the concave and convex flanges prior to mating the cover unit to the base unit.

4. The burial vault of claim 3 wherein the sealing material is an elastomeric substance.

5. The burial vault of claim 4 wherein the elastomeric substance used as a sealing material is Butyl rubber.

* * * * *